US006299688B1

(12) United States Patent
Marinaro et al.

(10) Patent No.: US 6,299,688 B1
(45) Date of Patent: Oct. 9, 2001

(54) DEVELOPER NOZZLE CLEAN COMBS

(75) Inventors: Vincent L. Marinaro, Sunnyvale; Eric R. Kent, San Jose, both of CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/389,577

(22) Filed: Sep. 3, 1999

(51) Int. Cl.[7] ..... B05C 5/00; B05C 21/00; B05B 15/02

(52) U.S. Cl. ..... 118/302; 15/104.001; 15/104.03; 15/104.05; 134/104.1; 239/114; 239/115

(58) Field of Search ..... 15/104.001, 104.03, 15/104.05, 104.16, 142, 236.06, 236.08; 134/104.1; 156/345; 118/70, 302; 239/106, 114, 115, 123

(56) References Cited

U.S. PATENT DOCUMENTS

| | | | | |
|---|---|---|---|---|
| 883,752 | * | 4/1908 | Spicer | 15/142 |
| 2,226,317 | * | 12/1940 | Myers | 15/104.001 X |
| 2,318,696 | * | 5/1943 | Linden | 15/104.05 |
| 2,812,531 | * | 11/1957 | Ashley | 15/373 |
| 3,414,925 | * | 12/1968 | Stavros | 15/104.001 |
| 3,994,040 | * | 11/1976 | DiStefano | 15/236.06 |
| 4,435,871 | * | 3/1984 | Johnson | 15/104.001 |
| 4,872,234 | * | 10/1989 | Wonnacott | 15/104.16 |
| 5,339,485 | * | 8/1994 | Ingram et al. | 15/236.06 |
| 5,922,139 | * | 7/1999 | Gilbert | 15/142 X |
| 6,210,481 | * | 4/2001 | Sakai et al. | 134/104.1 X |

FOREIGN PATENT DOCUMENTS

| | | | | |
|---|---|---|---|---|
| 600243 | * | 6/1978 | (CH) | 15/104.05 |
| 2054440 | * | 2/1981 | (GB) | 15/104.001 |
| 2251783 | * | 7/1992 | (GB) | 15/142 |
| 5-185003 | * | 7/1993 | (JP) | 118/302 |
| 57981 | * | 5/1937 | (NO) | 15/104.001 |

* cited by examiner

*Primary Examiner*—Mark Spisich
(74) *Attorney, Agent, or Firm*—Foley & Lardner

(57) ABSTRACT

A developer nozzle used to apply developer and other chemicals to a wafer in the processing of semiconductors is kept free of hardened developer or other chemicals by placing a comb-like device in a position that will let the comb be inserted into the spray holes of the nozzle when the nozzle is not in use. The teeth of the comb are tapered for easy insertion by the robot or other programmed device that controls motion of the nozzle. Although hardened developer is the principal concern in such processing, an appropriate comb can be used to maintain the cleanliness of other nozzles used in semiconductor processing.

12 Claims, 1 Drawing Sheet

DEVELOPER NOZZLE CLEAN COMBS

BACKGROUND OF THE INVENTION

This invention is related to the manufacture of semiconductor chips. In particular, it is an apparatus for cleaning a nozzle used in spraying developer on a wafer that is being processed.

The manufacture of semiconductor chips is carried out by securing a wafer of silicon or the like on a vacuum chuck that holds the wafer while it is being processed. The processes that are performed include placing a resist, placing a pattern on the resist by photolithography or the use of an imaging stepper to expose the resist, and developing the pattern. The wafer is moved from place to place for each stage of processing by some automatic means such as a controlled robot. At certain stages, the processing liquids are sprayed onto the wafer by an appropriate nozzle. The developer is typically sprayed through a commercially available nozzle referred to as an E-squared nozzle. An E-squared nozzle has a number of holes in a line that is approximately equal in length to the radius of a wafer. This radius may be four, six, or eight inches, although other dimensions may be used.

Sometimes developer hardens in one or more nozzles. When this happens, the nozzle deposits developer unevenly on the wafer, resulting in defective chips. This leads to scrap and to downtime while the nozzle is cleaned. Hardening of the developer is least likely to happen when the nozzle is in continual use, and it is most likely to happen when the line is shut down for some reason or when a particular process does not call for the application of developer for a time. It would increase production of semiconductor chips, improve quality of the chips produced, and reduce scrap if the E-squared nozzle in a developer station could be kept free of hardened developer.

SUMMARY OF THE INVENTION

An E-squared nozzle used to apply developer to a wafer in the processing of semiconductors is kept free of hardened developer by placing a comb-like device in a position that will let the comb be inserted into the spray holes of the nozzle when the nozzle is not in use. The teeth of the comb are tapered for easy insertion by the programmed device that controls motion of the nozzle. Although hardened developer is the principal concern in such processing, an appropriate comb can be used to maintain the cleanliness of other nozzles used in semiconductor processing.

DETAILED DESCRIPTION OF THE INVENTION

Figure 1:
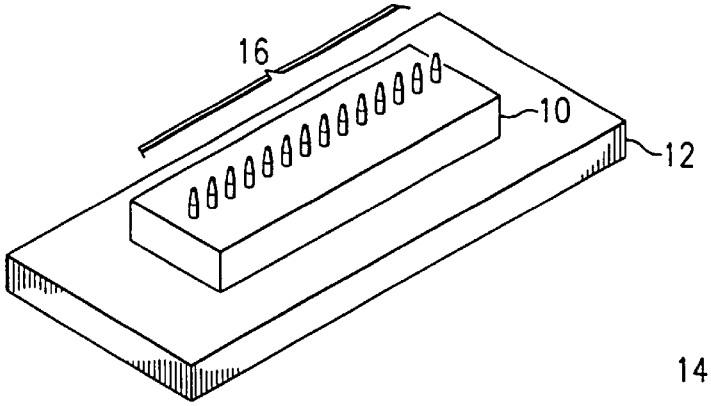
FIG. 1 is a perspective view of a comb for the practice of the present invention shown in the home position on a tray.
Figure 2:
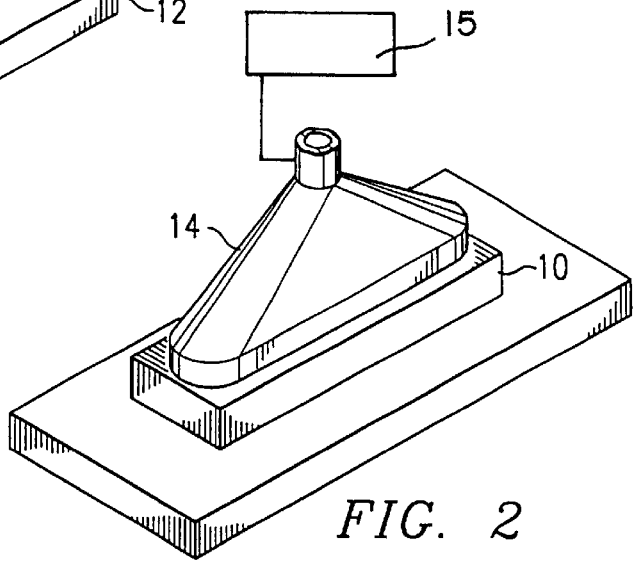
FIG. 2 is a view of a nozzle in the rest position showing the comb of FIG. 1 inserted into the nozzle.
Figure 4:
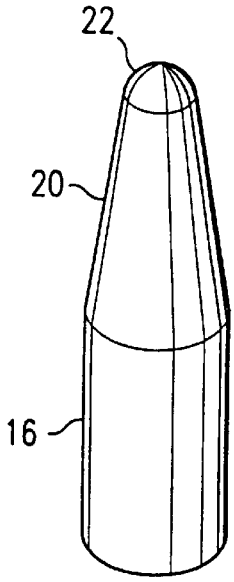
FIG. 4 is an enlarged view of a tooth of the comb of FIG. 1.

FIG. 1 is a perspective view of a comb 10 for the practice of the present invention shown in the home position on a tray 12 and FIG. 2 is a view of a nozzle 14 in the rest position showing the comb 10 inserted into the nozzle 14. FIG. 4 is an enlarged view of a tooth 16 of the comb 10 of FIG. 1. In FIGS. 1 and 2, the comb 10 is placed on the tray 12 that provides a home or rest position for the nozzle 14 that is used to spray developer solution onto semiconductor wafers as part of the processing of those wafers. The comb 10 has a number of teeth 16 equal in number to the number of holes 18 in the nozzle. After each use of the nozzle 14, during which it is moved by a robot 13 or the like into a processing position, the nozzle 14 is placed onto the teeth 16 of the comb. This prevents developer from hardening in the holes 18 of the nozzle 14 and causing the nozzle 14 to spray developer unevenly onto the wafer. The teeth 16 of the comb 10 are tapered for easy insertion by the programmed device 15 that controls motion of the nozzle.

Figure 3:
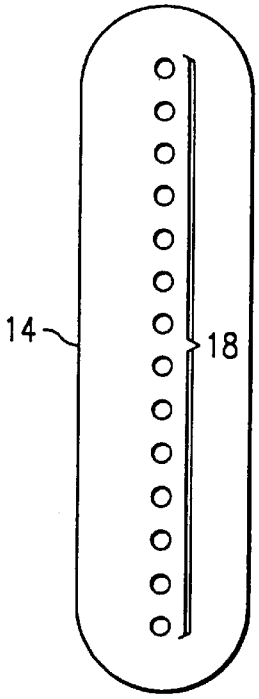
FIG. 3 is an end view of the nozzle showing the holes.

FIG. 3 is an end view of the nozzle 14 showing the holes 18. While the holes 18 are typically in a line as shown in FIG. 3, they may be in different alignments as produced by a manufacturer. In such a case the teeth 16 of FIG. 1 must be aligned so as to fit the alignment of the particular nozzle 14.

FIG. 4 is an enlarged view of a tooth 16 of the comb 10 of FIG. 1. The teeth 16 include conical portions 20 at the tips 22 to facilitate insertion of the teeth 16 into the holes 18 of the nozzle 14. The holes 18 are typically about 1 mm in diameter, the teeth 16 are about ¾ mm in diameter, and the comb teeth are about 4–8 mm long.

The disclosure of the invention provided above is intended to be illustrative and not limiting. The scope of the invention should be limited only by the claims and their equivalents.

We claim:

1. An apparatus for maintaining a spray nozzle in a clean condition, the spray nozzle having a plurality of holes, the apparatus comprising a plurality of teeth arranged in the form of a comb, the teeth sized and spaced to fit the holes in the spray nozzle, the teeth being mounted on a developer station tray, the developer station tray having a substantially horizontal member located below the teeth and the teeth being substantially vertical and extending in an upward position.

2. The apparatus of claim 1 wherein the teeth have tips that are conical.

3. The apparatus of claim 1 wherein the teeth have tips that are rounded cones having a portion of a diameter less than a diameter of the holes in the spray nozzle.

4. The apparatus of claim 2 wherein the teeth have sides that are substantially cylindrical.

5. The apparatus of claim 1 further including means for automatically moving the spray nozzle relative to the teeth from a first position, in which the teeth are not located within the holes of the spray nozzle to a second position to where the teeth are received within the holes of the spray nozzle, the teeth being in a vertical position and the developer station tray being in a horizontal position below the teeth in the second position.

6. The apparatus of claim 5 wherein the means for automatically moving the spray nozzle includes a robot and a programmed controller.

7. An apparatus for maintaining in a clean condition a spray nozzle for developer in a semiconductor processing line the spray nozzle having a plurality of holes producing the spray the apparatus comprising:

a plurality of teeth arranged in the form of a comb, the teeth being sized and spaced to fit within the holes in the spray nozzle, the teeth being substantially vertical and extending in an upward position; and a tray being substantially horizontal and located below the teeth to catch drips.

8. The apparatus of claim 7 wherein the teeth have tips that are conical.

9. The apparatus of claim 7 wherein the teeth have tips that are rounded cones having a portion of a diameter less than a diameter of the holes in the spray nozzle.

10. The apparatus of claim 7 wherein the teeth have sides that are substantially cylindrical.

11. The apparatus of claim 7 further including means for automatically moving the spray nozzle relative to the teeth from a first position, in which the teeth are not located within the holes of the spray nozzle to a second position to where the teeth are received within the holes of the spray nozzle, the teeth being in a vertical position and the developer station tray being in a horizontal position below the teeth in the second position.

12. The apparatus of claim 11 wherein the means for automatically moving the spray nozzle includes a robot and a programmed controller.

* * * * *